US005603633A

United States Patent [19]

Satoh

[11] Patent Number: 5,603,633

[45] Date of Patent: Feb. 18, 1997

[54] FLAT CABLE AND A CONNECTOR COOPERATING THEREWITH

[75] Inventor: Youichi Satoh, Kawasaki, Japan

[73] Assignee: Fujitsu Limited, Kawasaki, Japan

[21] Appl. No.: 385,921

[22] Filed: Feb. 9, 1995

Related U.S. Application Data

[62] Division of Ser. No. 278,226, Jul. 21, 1994.

[30] Foreign Application Priority Data

Sep. 22, 1993 [JP] Japan ..... 5-236797

[51] Int. Cl.[6] ..... H01R 4/24

[52] U.S. Cl. ..... 439/404

[58] Field of Search ..... 439/404–405, 439/492, 498, 499, 395

[56] References Cited

U.S. PATENT DOCUMENTS

| | | | |
|---|---|---|---|
| 3,097,036 | 7/1963 | Cornell, Jr. . | |
| 4,171,860 | 10/1979 | Katz . | |
| 4,230,898 | 10/1980 | Emmel . | |
| 4,484,791 | 11/1984 | Johnson | 439/404 |
| 4,486,619 | 12/1984 | Trine et al. . | |
| 4,925,401 | 5/1990 | Fogg et al. | 439/404 |
| 5,041,009 | 8/1991 | McCleerey | 439/405 |
| 5,104,336 | 4/1992 | Hatanaka et al. | 439/404 |
| 5,326,286 | 7/1994 | Bixler et al. | 439/405 |
| 5,327,513 | 7/1994 | Nguyen et al. . | |
| 5,332,395 | 7/1994 | Wen-Yu | 439/405 |
| 5,338,221 | 8/1994 | Bowen et al. | 439/405 |

FOREIGN PATENT DOCUMENTS 59-98409 6/1984 Japan .

*Primary Examiner*—P. Austin Bradley
*Assistant Examiner*—Jill DeMello
*Attorney, Agent, or Firm*—Armstrong, Westerman, Hattori, McLeland & Naughton

[57] ABSTRACT

A flat connector cable assembly includes a connector having two rows of contact elements, a flat cable assembly formed of first and second flat cables respectively connected to first rows and second rows of the contact elements, and a fixture element for holding the first and second flat cables to form a single flat cable, wherein the fixture element holds the plurality of cables of the second flat cable with gaps formed therebetween such that the plurality of cables of the first flat cable are held in respective gaps formed between the cables of the second flat cable, and such that the fixture element holds the plurality of cables of the first flat cable with gaps formed therebetween such that the plurality of cables of the second flat cable are held in respective gaps formed between the cables of the first flat cable.

2 Claims, 6 Drawing Sheets

FIG. 7A
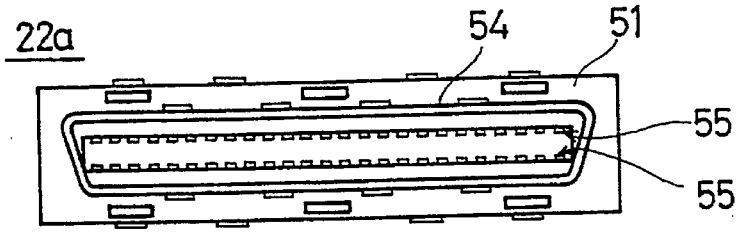
FIG. 7C
FIG. 7B
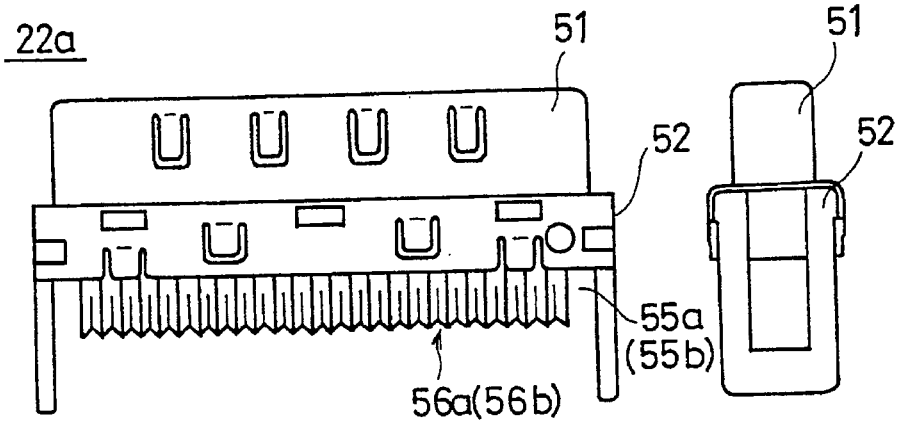
FIG. 7D
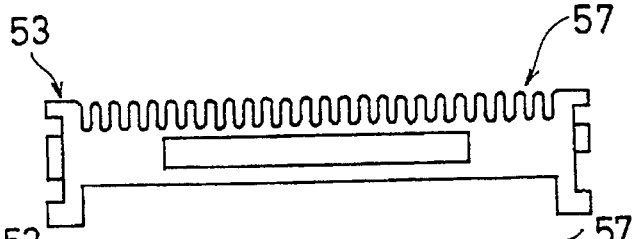
FIG. 7E
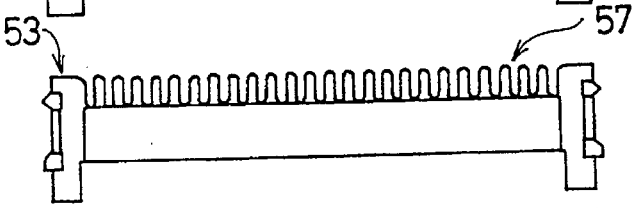

FLAT CABLE AND A CONNECTOR COOPERATING THEREWITH

This is a division of application Ser. No. 08/278,226, filed Jul. 21, 1994.

BACKGROUND OF THE INVENTION

The present invention relates to a flat cable and a connector cooperating therewith for transmitting information signals in information processing apparatuses.

With increase in the number of signals to be processed in recent information processing apparatuses, use of so-called flat cables is increasing for transmitting the signals between various information processing apparatuses. Most of such flat cables and corresponding connectors are designed according to the SCSI (small computer system interface)-II protocol known also as FAST-SCSI prescribed by ANSI (American National Standard Institute), particularly with regard to the pin assignment. Thus, there is a need to design the flat cables and connectors in compliance with the SCSI-II protocol while minimizing crosstalk between the signal cables.

Conventionally, the flat cables have been designed such that signal cables for carrying signals and power cables for supplying the electric power have been disposed alternately for avoiding crosstalk between the signals. By disposing the signal cables and the power cables alternately in the flat cable, it is possible to minimize the adversary effect on the waveform of the signals transmitted along the signal cables. Thus, the connector provided at an end of such a flat cable also has a pin assignment such that the pins for the signal cables and the pins for the power cables are disposed alternately.

In the foregoing SCSI-II interface, on the other hand, it is prescribed such that two rows of pins are provided in the connector and such that the pins for signals are only in one of the foregoing two rows of the pins.

FIG. 1A shows the construction of a conventional connector cable 11A including a connector 12 and cooperating a cable assembly 15 designed according to the SCSI-II protocol, wherein the connector includes pins or contact elements disposed in two rows.

Referring to FIG. 1A, it will be noted that the connector 12 includes a contact part 13 and a cable interface part 14, wherein the contact part 13 includes contact elements for electric connection to a corresponding connector, while the cable interface part 14 is provided with two rows of terminals in electrical connection to the corresponding contact elements of the contact part 13, for connection of the cable assembly 15. The cable assembly 15, in turn, is formed of two flat cables 15*a* and 15*b*, and each cable forming the flat cables 15*a* and 15*b* is connected to a corresponding terminal by way of press contact achieved by connector housings 16*a* and 16*b*. It should be noted that each of the cables 15*a* and 15*b* extend in the direction of insertion of the connector cable 11A to a corresponding socket or connector.

FIG. 1B shows another conventional connector cable 11B formed of a connector 17 and a cable assembly 15. The connector 17 includes a contact part 18 and a cable interface part 19, wherein the contact part 18 includes contact elements for interconnection to a corresponding socket or connector. On the other hand, the cable interface part 19 has terminals in electrical connection to the contact elements in the contact part 18, for connection of the flat cables 15*a* and 15*b*. The individual cables forming the flat cables 15*a* and 15*b* are connected to corresponding cable terminals by way of press contact at a connector housing 20, and the flat cables 15*a* and 15*b* extend from both sides of the housing 20.

Thus, the foregoing conventional connector cables 11A and 11B have the feature that two flat cables 15*a* and 15*b* extend from the cable interface part 14 or 19. In any of the connector cables 11A and 11B, it is necessary to use one of the flat cables such as the flat cable 15*a* explicitly for carrying signals and the other flat cable 15*b* explicitly for carrying the electric power, in order to design the connector 12 or 17 in compliance with the pin assignment of the SCSI-II protocol.

In the foregoing connector 11A or 11B designed as such, it should be noted that the signal cables and the power cables are no longer disposed alternately in the flat cables 15*a* and 15*b*. Thus, there occurs a problem in that such conventional SCSI-II cable connectors are vulnerable to crosstalk of the signals in the flat cables.

SUMMARY OF THE INVENTION

Accordingly, it is a general object of the present invention to provide a novel and useful flat cable and a connector using such a flat cable wherein the foregoing problems are eliminated.

Another and more specific object of the present invention is to provide a flat cable and a connector using such a flat cable wherein occurrence of crosstalk in the flat cable is minimized, even in the case that the connector is designed according to a pin assignment in which one of the two rows of pins of the connector is used exclusively for carrying signals.

Another object of the present invention is to provide a flat cable, comprising:

a plurality of cables each including a conductive core and an insulating cover for insulating the conductive core, said plurality of cables being disposed substantially parallel with each other and aligned in a single row when viewed from an elongating direction of said cables, with a mutual separation; and fixture means for holding said plurality of cables such that said plurality of cables are held each other with said mutual separation.

Another object of the present invention is to provide a flat connector cable assembly, comprising:

a connector including: a contact part for contact engagement with another connector; and a cable interface part; and a flat cable assembly in connection to said cable interface part of said connector;

said contact part including: conductive contact elements provided in two rows for contact engagement with said another connector; and terminals aligned in two rows in correspondence to and in electrical connection to said contact elements;

said flat cable assembly comprising first and second flat cables each including:

a plurality of cables each including a conductive core and an insulating cover for insulating said conductive core, said plurality of cables being disposed substantially parallel with each other and aligned in a single row when viewed from an elongating direction of the said cables, with a mutual separation such that gaps are formed between said plurality of cables; and fixture means for holding said plurality of cables forming said first and second flat cables substantially in a row when viewed from an elongating direction of said cables to form a single flat cable, such that said plurality of cables forming said second flat cable are held in respective gaps formed between said cables of said first flat cable and such that said plurality of cables forming said first flat cable are held in respective gaps of said cables forming said second flat cable.

According to the present invention, said first and second flat cables are fixed with each other by said fixture means, such that the cables of said first flat cable and the cables of said second flat cable are repeated alternately in said single flat cable formed by the fixture means. Further, one of the first and second flat cables such as the first flat cable is used for carrying signals while the second flat cable is used for supplying electric power in compliance with the SCSI-II protocol. Thus, it is possible to clear the requirement of the SCSI-II protocol with regard to the arrangement of the conductive contact elements at the connector while simultaneously minimizing crosstalk between the signals carried by the first flat cable. It should be noted that the cable for carrying a signal and the cable for carrying electric power are repeated alternately in the single flat cable formed by the fixture means.

Other objects and further features of the present invention will become apparent from the following detailed description when read in conjunction with the attached drawings.

BRIEF DESCRIPTION OF THE DRAWINGS

FIGS. 7A–7E are diagrams showing the construction of a connector forming a part of the flat cable connector of FIG. 6.

DETAILED DESCRIPTION OF THE PREFERRED EMBODIMENTS

Figure 2:
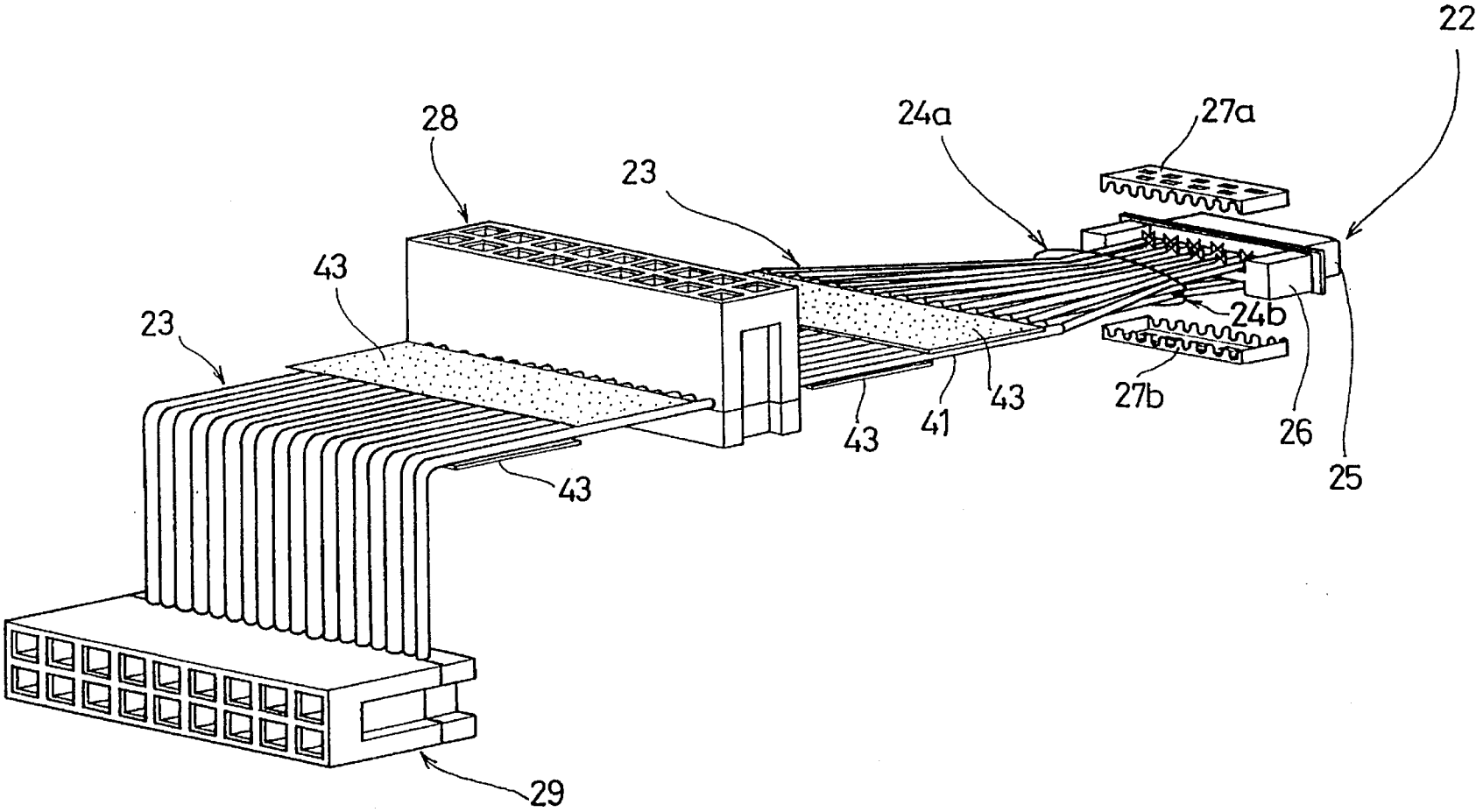
FIG. 2 is a diagram showing the overall construction of the flat cable connector according to a first embodiment of the present invention.

FIG. 2 shows a flat cable connector 21 according to a first embodiment of the present invention in a perspective view.

Referring to FIG. 2, the flat cable connector 21 includes a connector 22 and a flat cable 23 having a first end connected to the connector 22. The flat cable 23 is actually formed of two flat cables 24*a* and 24*b* as will be described later in detail. On the other hand, the connector 22 is formed of a contact part 25 for engagement with a corresponding connector and a cable connection interface part 26 for connecting the flat cable 23 upon the connector 22. As will be described with reference to FIGS. 3A–3E, the cable connection interface part 26 includes first and second housing members 27*b* and 27*b* that achieve a press engagement of the flat cables 24*a* and 24*b* upon the interface part 26.

It should be noted that the flat cable 23 includes a plurality of cables 41 extending parallel with each other and aligned in a single row when viewed from an extending direction of said cables 41, except for the foregoing first end. Further, the flat cable 23 includes a through-type intermediate connector 28 at an intermediate position of the cable 23 for branching the cables, and further carries an end connector 29 at an opposite, second end. The connector 22 and the end connector 29 are used for connecting various information processing apparatuses by way of the flat cable 23.

Figure 3A:
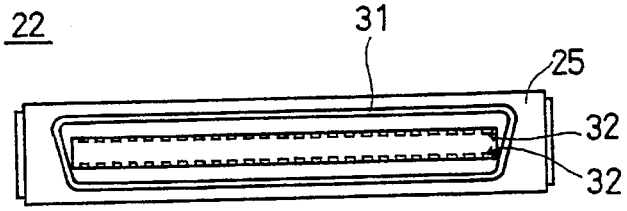
FIGS. 3A–3E are diagrams showing the construction of a connector forming a part of the flat cable connector of FIG. 2.
Figure 3B:
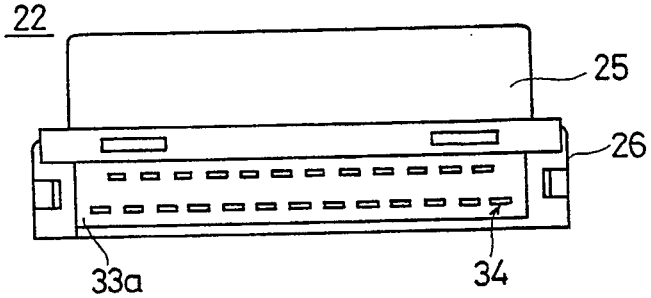
Figure 3C:
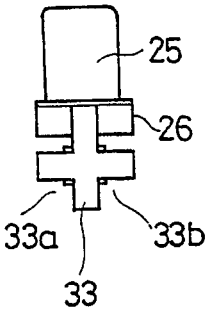
Figure 3D:
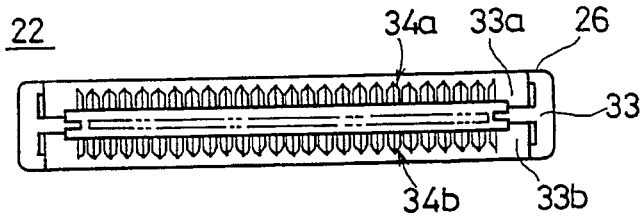
Figure 3E:
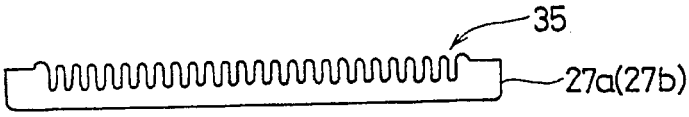

FIGS. 3A–3E show the connector 22 in detail, wherein FIG. 3A shows the contact part 25 of the connector 22 in a front view, FIG. 3B shows the contact part 25 in a plan view, and FIG. 3C shows the contact part 25 in a side view. Further, FIG. 3D shows the cable connection interface part 26 in a rear view of the connector 22, while FIG. 3E shows housing members 27*b* and 27*b* cooperating with the cable connection interface part 26 of FIG. 3D.

As shown in FIG. 3A, the contact part 25 carries a guide member 31 for mechanical-engagement with a corresponding guide member of another connector, as well as two rows of contact elements 32 of a conductive material for contact engagement with corresponding contact elements of the corresponding connector. It should be noted that the contact part including the guide 31 and the contact elements 32 are designed in compliance with the SCSI-II protocol.

As indicated in FIG. 3B, the cable connection interface part 26 is formed behind the contact part 25 in continuation therewith, wherein the interface part 26 includes an upper region 33*a* and a lower region 33*b* separated from each other by an insulating member 33 as indicated in the side view of FIG. 3C. Further, as will be noted from FIG. 3D, terminals 34*a* and 34*b*, respectively in electrical connection to the contact elements 32, are provided on the upper region 33*a* and the lower region 33*b* as indicated in FIG. 3D, wherein the contact elements 32 forming the upper row in FIG. 3A are connected to the terminals 34*a* and the contact elements 32 forming the lower row are connected to the terminals 34*b*. Each of the terminals 34*a* forms a sharp-pointed pin extending upward from the region 33*a*. Similarly, each of the terminals 34*b* forms a sharp pointed pin extending downward from the region 33*b*.

Each of the housing members 27*b* and 27*b* of FIG. 3E, on the other hand, is formed of a rigid insulating member provided with predetermined depressions corresponding to the pins 34*a* and 34*b*. Each of the depressions forms a groove having a width corresponding to the diameter of the cables 41 forming the flat cables 24*a* and 24*b*. Thus, the individual cables 41 forming the flat cable 24*a* are held in corresponding grooves of the housing member 27*b*, and the housing member 27*b* is placed over the region 33*a* such that the grooves engage with the corresponding pins 34*a* on the region 33*a*. Similarly, the individual cables 41 of the flat cable 24*b* are held in corresponding grooves of the housing member 27*b*, and the housing member 26*b* is placed below the region 33*b* such that the grooves engage with the corresponding pins 34*b* on the region 33*b*. Further, by urging the housing members 27*b* and 27*b* to approach with each other by applying a force, the sharp-pointed pins 34*a* on the region 33*a* penetrate through the insulating coating of the cables 41 held in the grooves, and the pins 34*a* establish a desired electrical contact with the conductive cores of the cables 41 forming the flat cable 24*a*. Similarly, the sharp-pointed pins 34*b* on the region 33*b* penetrate through the insulating coating of the cables 41 held in the grooves and the pins 34*b* establish a desired electrical contact with the conductive cores of the cables 41 forming the flat cable 24*b*.

Figure 4A:
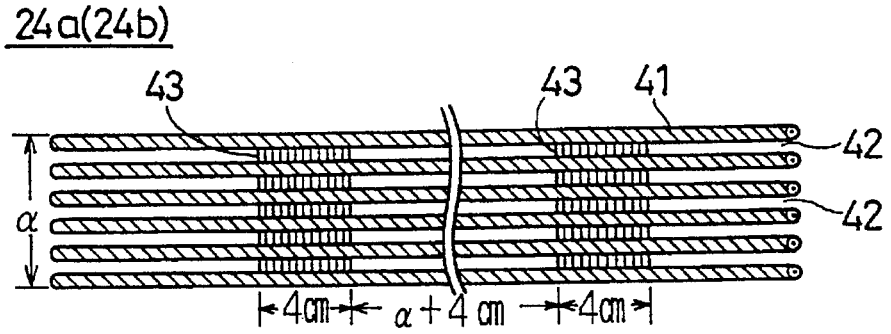
FIGS. 4A and 4B are diagrams showing the construction of flat cables used in the flat cable connector of FIG. 2.
Figure 4B:
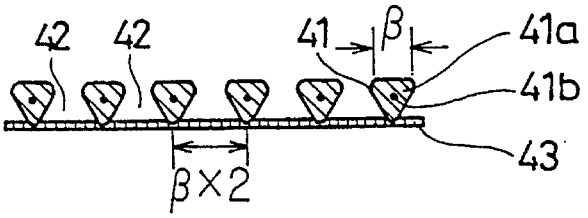

Next, the construction of the flat cables 24*a* and 24*b* of FIG. 2 will be described in detail with reference to FIGS. 4A and 4B, wherein FIG. 4A shows the cable 41 in a plan view while FIG. 4B shows the cable 41 in the cross sectional view. In FIGS. 4A and 4B, the construction of the flat cable 24*a* is identical with the construction of the flat cable 24*b*. Thus, the description will be given only to the construction of the flat cable 24*a*.

Referring to FIG. 4A, a plurality of the cables 41 forming the flat cable 24*a* and extending generally parallel with each other are fixed upon a fusible tape 43 with a predetermined mutual separation or gap 42. In the illustrated example, six of such cables 41 each having a diameter β are disposed, and the flat cable 24*a* has a total width α.

Referring to the cross sectional view of FIG. 4B, it will be noted that each of the cables 41 has a triangular cross section and disposed with a mutual separation of less than 2β, wherein it will be noted that the fusible tape 43 is fused or welded upon the triangular cables 41 such that the apex of the triangular cable is bonded firmly upon the fusible tape 43. By bonding the cables 41 upon the tape 43 in the form of inverted triangles with the mutual separation set smaller than 2β as indicated in FIG. 4B, the separation between the cables 41 at the base part of the triangles becomes smaller than the diameter β of the individual cable 41.

It should be noted that the fusible tape 43 is formed of a material such as polyester or polyethylene that causes a fusion bonding with the insulating coating of the cable 41 upon heating. Typically, the fusible tape 43 has a width of 4 cm in the extending direction of the cables 41, and two such tapes 43 are provided along the cables 41 with a separation of 4 mm+α, wherein e represents the width of the flat cable 24*a* formed form the cables 41.

The flat cable 24*b* is formed similarly. Thus, the two flat cables, 24*a* and 24*b*, extend adjacent to each other from the connector 24 as indicated in FIG. 2, wherein the flat cables 24*a* and 24*b* form two separate cable portions facing each other at the foregoing first end of the flat cable 23.

Figure 5A:
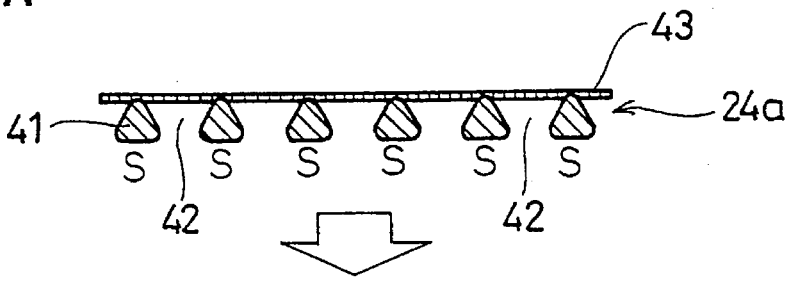
FIGS. 5A–5C are diagrams showing the process of forming a single integral flat cable used in the flat cable connector of FIG. 2 from two separate flat cables.
Figure 5B:
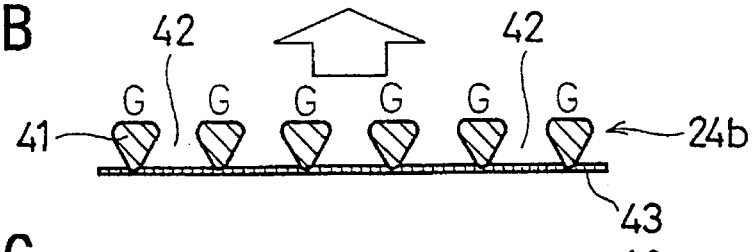
Figure 5C:
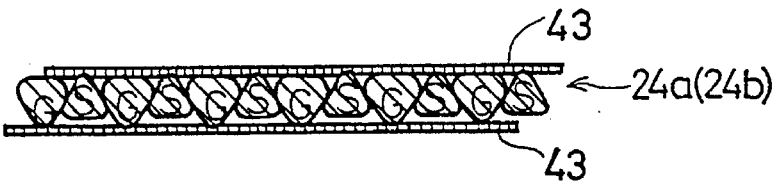

The flat cables 24*a* and 24*b* are assembled with each other at the foregoing fusible tape 43 as indicated in FIGS. 5A–5C, wherein FIG. 5A shows the flat cable 24*a* in the state that the cables 41 are bonded to the fusible tape 43 at the top apex. It should be noted that the cables 41 of FIG. 5A are used for carrying the signals and designated in FIG. 5A as "S." FIG. 5B, on the other hand, shows the flat cable 24*b* in the state that the cables 41 are bonded to the fusible tape 43 at the bottom apex. The cables 41 of FIG. 5B are used for supplying electric power including the ground level and designated as "G."

The flat cable 24*a* of FIG. 5A and the flat cable 24*b* of FIG. 5B are then pressed with each other as indicated in FIGS. 5A and 5B by arrows. Thereby, the triangular cables 41 of FIG. 5A and the triangular cables 41 of FIG. 5B experience an elastic engagement with each other as indicated in FIG. 5C. In the state of FIG. 5C, it should be noted that the cables 41 designated as "S" for the signals such as clocks and data and the cables 41 designated as "G" for the power supply are repeated alternately to form a single flat cable corresponding to the flat cable 23 of FIG. 2.

Figure 1A:
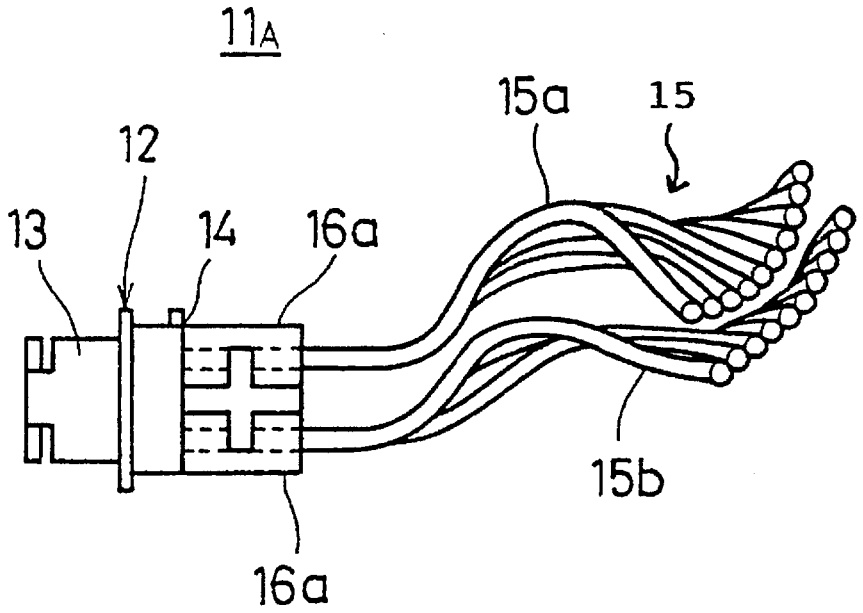
FIG. 1A PRIOR ART
FIGS. 1A and 1B show the construction of conventional flat cable connectors.
Figure 1B:
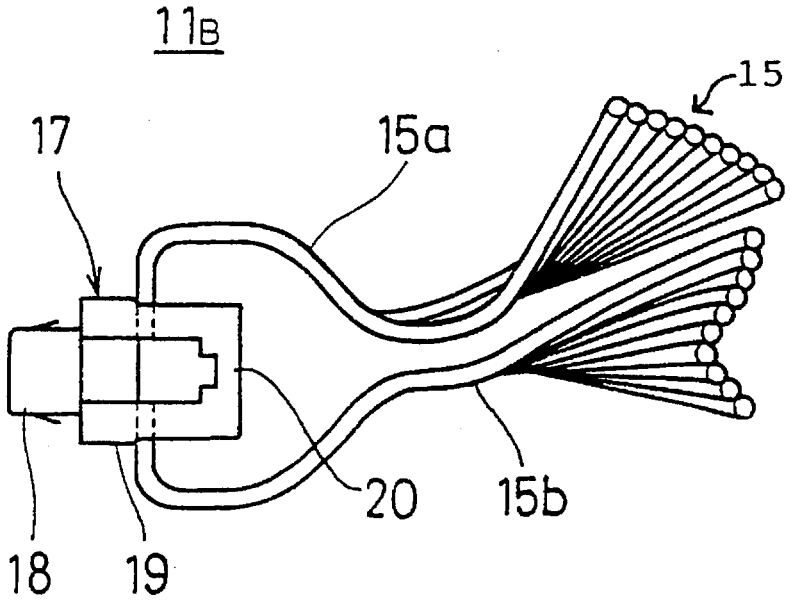
FIG. 1B PRIOR ART

Thus, by configuring the flat cables 24*a* and 24*b* to form a single flat cable as described above, it becomes possible to eliminate the crosstalk between the signal lines in the flat cable 24*a* substantially while still complying with the SCSI-II protocol at the connector 22. Further, it is possible to connect similar flat cables by way of the through type connector 28 as indicated in FIG. 1. In the foregoing embodiment, it should be noted that the cross section of the cables is not limited to the triangular cross section but may be a mushroom-like cross section or any other cross section that is effective for elastic engagement between the cables in the state of FIG. 5C. Further, one may form a flat cable from the flat cables 24*a* and 24*b* without specific cross sectional shape for the cables 41 as long as the cables 41 are held With each other by suitable holding means.

Figure 6:
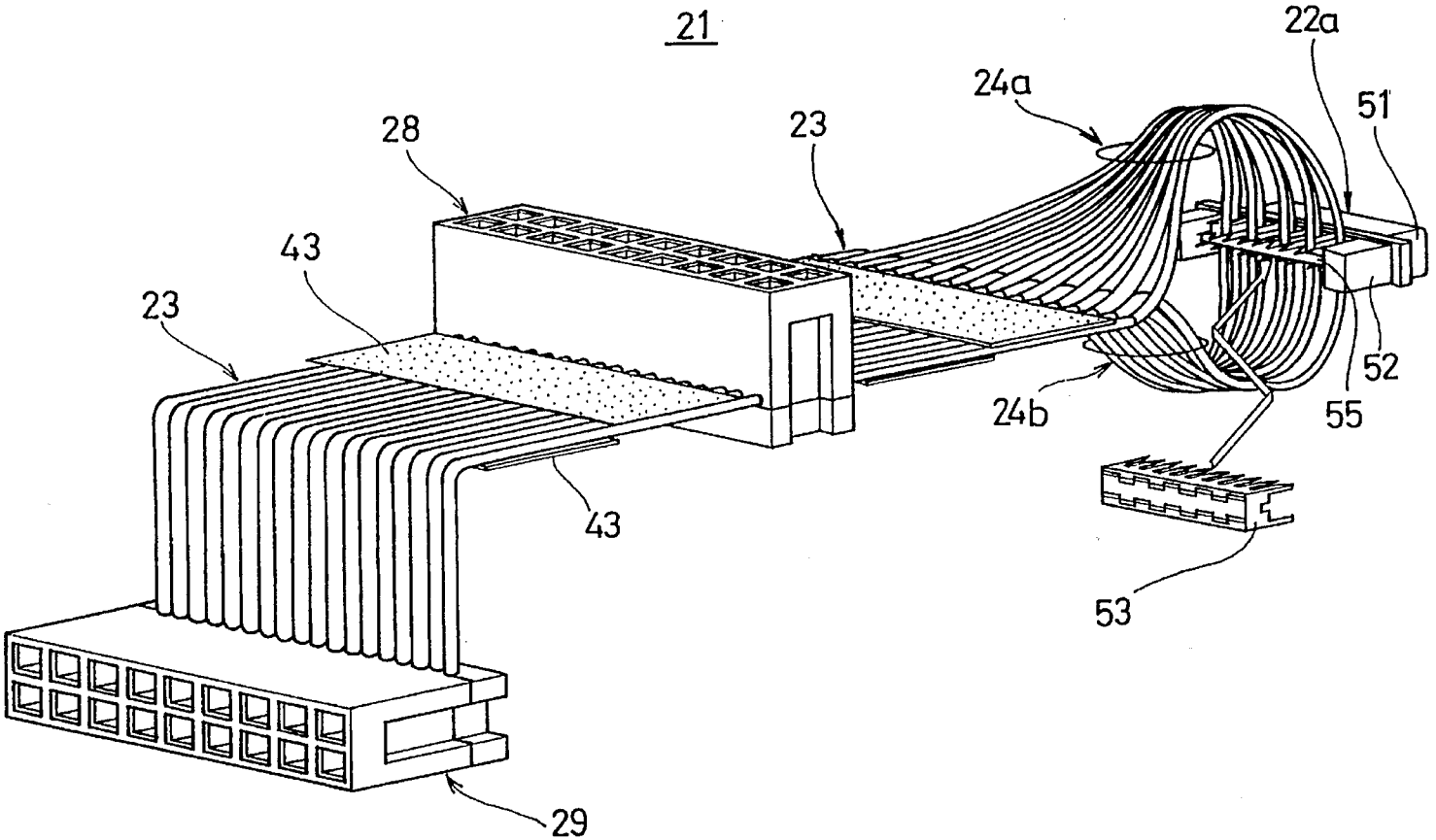
FIG. 6 is a diagram showing the overall construction of the flat cable connector according to a second embodiment of the present invention.

Next, a flat cable connector 21*a* according to a second embodiment of the present invention will be described with reference to FIG. 6. In FIG. 6, those parts corresponding to the parts described previously are designated by the corresponding reference numerals and the description thereof will be omitted.

Referring to FIG. 6 showing the flat cable connector 21 in a perspective view, it will be noted that the flat cable connector 21 has a connector 22*a* in which the flat cables 24*a* and 24*b* are connected to the connector 22*a* at both lateral sides thereof such that the cables in the flat cable 24*a* and the cables in the flat cable 24*b* oppose with each other.

More specifically, the connector 22*a* includes a contact part 51 for engagement with another connector and a cable connection interface part 52, wherein the contact part 51 corresponds to the contact part 25 and the cable connection interface part 52 corresponds to the cable connection interface 26 of FIG. 2. The interface part 52 includes a housing element 53 for achieving the press contact of the cables 24*a* and 24*b* upon the interface part 52.

FIGS. 7A–7C show the construction of the contact part 51 of the connector 22*a*, wherein FIG. 7A shows the contact part 51 in a front view, FIG. 7B shows the contact part 51 in a plan view, and FIG. 7C shows the contact part 51 in a side view. Further, FIGS. 7D and 7E show the housing element 53 respectively in the front view and in the plan view.

Referring to FIG. 7A, the contact part 51 has a guide 54 for mechanical engagement with another connector, and contact elements 55 of a conductive material are provided in the guide 54 in two rows in compliance with the SCSI-II protocol.

As indicated in FIGS. 7B and 7C, the cable connection interface part 52 is formed of an upper first region 55*a* and a lower second region 55*b* separated from each other by an intervening insulator member 55, wherein the first region 55*a* carries a plurality of sharply-pointed pins 56*a* in electrical connection to the contact elements 54 forming the upper row in FIG. 7A. Similarly, the second region 55*b* carries a plurality of sharply-pointed pins 56*b* in electrical connection to the contact elements 54 forming the lower row in FIG. 7A. It should be noted that the first and second regions 55*a* and 55*b* commonly face in the rear direction of the connector 22*a*, and the sharply-pointed pins 56*a* and 56*b* extend also in the rear direction of the connector 22*a*.

Further, the housing element 53 carries thereon a number of grooves 57 in correspondence to the sharply-pointed pins 56*a* or 56*b* on the cable connection interface part 52. Thus, by holding the cables 41 forming the flat cables 24*a* and 24*b* in the corresponding grooves 57 of the respective housing members 53 and urging the respective housing members 53 firmly against the regions 55*a* and 55*b* of the interface part 52, the sharp-pointed pins 56*a* and 56*b* penetrate into the cables 41 through the insulating coating and the desired electric connection is achieved between the conductive core 41*b* of the cables 41 and the pins 56*a* and 56*b*.

In the present embodiment, the cables 24*a* and 24*b* are assembled to form the single flat cable 23 similarly to the embodiment of FIGS. 5A–5C.

Further, the present invention is not limited to the embodiments described heretofore, but various variations and modifications may be made without departing from the scope of the invention.

What is claimed is:

1. A flat cable connector assembly, comprising:

a connector including: a contact part for contact engagement with another connector; and a cable interface part; and a flat cable assembly in connection to said cable interface part of said connector;

said contact part including: conductive contact elements provided in two rows for contact engagement with said other connector; and terminals aligned in two rows in correspondence to and in electrical connection to said contact elements;

said flat cable assembly comprising first and second flat cables each including:

a plurality of cables each including a conductive core and an insulating cover for insulating said conductive core, said plurality of cables being disposed substantially parallel with each other and aligned in a single row when viewed from an elongating direction of said cables, with a mutual separation such that gaps are formed between said plurality of cables; and fixture means for holding said plurality of cables forming said first and second flat cables substantially in a row when viewed from an elongating direction of said cables to form a single flat cable, such that said plurality of cables forming said second flat cable are held in respective gaps formed between said cables of said first flat cable and such that said plurality of cables forming said first flat cable are held in respective gaps of said cables forming said second flat cable;

wherein each of said cables forming said first and second flat cables have a triangular cross section, said fixture means comprises a first fixture member carrying thereon said cables of said first flat cable by bonding to an apex of said triangular cross section, and a second fixture member carrying thereon said cables of said second flat cable by bonding to an apex of said triangular cross section, wherein said cables of said first flat cable and said cables of said second flat cable establish a mechanical engagement.

2. A flat cable connector as claimed in claim 1, wherein said first and second fixture members are formed of a fusible tape that causes a fusion to said insulating cover, and wherein said first fixture member is disposed, in said fixture means, to be coincident to a first side of said single flat cable, said second fixture member is disposed, in said fixture means, to be coincident to a second, opposite side of said single flat cable.

* * * * *